US010063961B2

(12) United States Patent
Paris et al.

(10) Patent No.: US 10,063,961 B2
(45) Date of Patent: Aug. 28, 2018

(54) CHAMBERED ENCLOSURE FOR USE WITH AUDIO LOUDSPEAKERS

(71) Applicants: Charles M Paris, Wilmington, DE (US); Karen R. Parenti, Aston, PA (US)

(72) Inventors: Charles M Paris, Wilmington, DE (US); Karen R. Parenti, Aston, PA (US)

( * ) Notice: Subject to any disclaimer, the term of this patent is extended or adjusted under 35 U.S.C. 154(b) by 191 days.

(21) Appl. No.: 15/247,022

(22) Filed: Aug. 25, 2016

(65) Prior Publication Data

US 2017/0070812 A1 Mar. 9, 2017

Related U.S. Application Data

(60) Provisional application No. 62/283,600, filed on Sep. 8, 2015.

(51) Int. Cl.
*H04R 1/28* (2006.01)

(52) U.S. Cl.
CPC ..... *H04R 1/2811* (2013.01)

(58) Field of Classification Search
CPC .. H04R 1/2811; H04R 1/2873; H04R 1/2888; H04R 2201/02
USPC ..... 181/148, 199, 155, 156; 381/345, 349, 381/351
See application file for complete search history.

(56) References Cited

U.S. PATENT DOCUMENTS 4,286,688 A * 9/1981 O'Malley ..... H04R 1/2834 181/156
4,392,548 A * 7/1983 Bailey ..... H04R 1/42 181/152
4,509,615 A * 4/1985 Hruby ..... H04R 1/2896 181/145
4,591,020 A * 5/1986 Hruby, Jr. ..... H04R 1/2888 181/145
4,618,025 A * 10/1986 Sherman ..... H04R 1/22 181/148
5,216,210 A * 6/1993 Kammer ..... H04R 1/2834 181/144
5,374,124 A * 12/1994 Edwards ..... H04R 3/12 181/145
6,389,146 B1 * 5/2002 Croft, III ..... H04R 1/2842 381/345
7,103,193 B2 * 9/2006 Croft, III ..... H04R 1/2842 181/145
7,477,755 B2 * 1/2009 Saiki ..... H04R 1/2803 381/345
7,481,295 B2 * 1/2009 Noro ..... H04R 1/2834 181/156
8,094,842 B2 * 1/2012 Noro ..... H04R 1/2834 181/155

* cited by examiner

*Primary Examiner* — Jeremy Luks

(57) ABSTRACT

Exemplary embodiments relate to a new audio speaker housing design that includes one or more of several improved features. The housing may include a sealed enclosure designed to have a volume of air that relates to the moving mass of the audio driver piston. The housing may include partition walls that create sub-chamber(s). The partition walls may include concentrically arranged ports into the sub-chambers designed to reduce the sound waves propagating back to the audio driver. The housing may also include inverted dome(s), walls with partial depth ports, and/or walls with an elastomeric lining.

18 Claims, 14 Drawing Sheets

Prior Art

CHAMBERED ENCLOSURE FOR USE WITH AUDIO LOUDSPEAKERS

CROSS-REFERENCE TO RELATED APPLICATIONS

This application claims priority to and the benefit under 35 U.S.C. § 119(e) of U.S. Provisional Patent Application Ser. No. 62/283,600, filed Sep. 8, 2015 and entitled "CHAMBERED ENCLOSURE FOR USE WITH AUDIO LOUDSPEAKERS," the full contents of which are hereby incorporated herein by reference.

BACKGROUND

Loudspeaker drivers convert an electrical signal to sound by actuating an electromagnet connected to a piston which vibrates in air; sound emanates from both sides of the driver's piston, but while the waves are equal in force they are opposite in phase. So, the maximum audible power obtainable from a loudspeaker is one-half of the total sound energy at the piston, and in practice it is usually much less than that. Further, where these waves meet, they have the opportunity to cancel one another by means of destructive wave interference. A purpose, therefore, of isolating and neutralizing the sound from one side of the driver, is to prevent the energy from that rearward wave from impinging in any way upon the sound projecting forward by the initial action of the driver. Negative effects can manifest by a variety of means, including interference, echoing within the enclosure returning to bounce against the piston, re-radiation through the enclosure walls, setting the enclosure walls into vibration as if they were secondary pistons, as well as port effects. These can reduce the overall performance of the loudspeaker, e.g., by reducing the efficiency of sound production, distorting the sound as compared to the input signal, and phase shifting certain frequencies to cause the tones to be less distinct.

There are two major design groups for audio loudspeakers: sealed and vented. The sealed group specifies a fixed quantity of air that is held in the enclosure for any given driver, and is subdivided into "infinite baffle" and "acoustic suspension" types. Vented loudspeakers employ substantial containment with a port or other means by which a certain quantity of the contained air volume is exchanged with air outside of the enclosure in response to the piston action, and is subdivided into "bass-reflex" and "passive radiator" types.

Infinite baffle is used extensively by driver manufacturers in testing and producing performance curves for their products. One way infinite baffle is manifested is to construct a heavy, soundproofed wall between two rooms and mount a driver in a hole on that wall. The baffle room, behind the driver, is large enough such that no sound wave projecting rearward meets with any surface such that it can reflect and return to the piston surface with enough force to have any measurable effect on the sound projecting into the test room. The test room, forward of the driver, is usually constructed so as to be anechoic, such that sounds measured in the test room are those emanating only from the driver, without room absorption or reflection affecting the sound production. The infinite baffle enclosure may create an environment in which a driver can perform at or near its full capability, and performance curves and specifications obtained in this environment may provide a uniform basis from which loudspeaker designers and engineers can compare drivers from different manufacturers with a reasonable expectation that the results are direct comparisons. The arrangement described is usually a permanent installation, as room sizes are on the order of 1,000 cubic feet or more. Infinite baffle is also possible in a portable enclosure which may simply be a sealed box where the enclosed volume is large enough such that its pneumatic compliance $C_{ab}$ (defined as being inversely proportional to the spring constant of the enclosed air volume) is greater than the suspension compliance specification $C_{as}$ of the driver mounted in it. $C_{as}$ is also an inverse relation, in this case of the spring constant established by the surround and spider suspending the piston in the driver's frame. The relation of $C_{as}$ to $C_{ab}$ provides for a finite enclosure wherein the air volume resonance has minimal effect on the action of the piston. The portable infinite baffle enclosure was used extensively in early electronic audio but due to the large box sizes needed, as well as inherent performance limitations, it has largely been superseded by other types of enclosures.

The acoustic suspension enclosure is a sealed box design which may define the compliance ratio of $C_{as}$ to $C_{ab}$ so that the contained air volume becomes an integral part of the driver's suspension. This design may be characterized as having good fidelity to the original recording, smaller enclosures than infinite baffle, and being relatively easy to build. Some drawbacks of this enclosure type are problems associated with containment such as echoes, standing waves, and the slow decay of low frequency tones. As frequency declines, wavelength and the total quantity of energy carried by a single note both may increase. The acoustic suspension's sealed environment may depend largely on time to degrade wave energy, which permits low frequency energy to disrupt sound production while declining in intensity. To obtain acceptable bass production, acoustic suspension loudspeakers may require relatively large diameter drivers which may represent a larger cost. For example, a 12-inch diameter driver may be necessary to obtain a lower limit of 60 Hz using acoustic suspension technology where an 8-inch driver may be able to produce the same 60 Hz in a bass-reflex enclosure.

A. C Thuras was granted a patent in 1932 for a loudspeaker having a vent to exchange air in response to the piston action of the driver. Much effort from many researchers over the next several decades, including Thiele (1961) and Small (1973) for whom the industry standard "Thiele/Small Parameters" are named, resulted in a systemization of the variables associated with both of the major groups of loudspeaker design. This was especially valuable to designers of bass-reflex systems because of the increased complexity. In the absence of a driver, the bass-reflex enclosure may act as a Helmholtz resonator wherein the relative masses of the enclosed air and the air occupying the port tube move together to establish a frequency at which the device resonates in response to an impulse. Any such resonator may have one characteristic frequency. An advantage of introducing box resonance to the loudspeaker may include a quicker way to dissipate the energies associated with long, powerful sound waves contained by the enclosure: e.g., the Helmholtz resonant action dissipates energy through the port. A carefully tuned bass-reflex loudspeaker may produce sound frequencies as low as 20 Hz (the lower limit of human hearing) in a box that may be relatively easy to manufacture, move and install, e.g., with fairly good sound fidelity. Using the same driver, bass-reflex designs may produce frequencies as much as a full octave deeper in tone than a sealed unit. They can be more complex to engineer but the cost of production is a minimal increase once a design is established, and this may account for the tremendous popularity of the design type. A problem with vented design is the inclusion of box resonance as a dynamic element of sound reproduction: the energy dissipated through the port is typically not a genuine representation of the electrical signal at the driver, yet it is heard along with the sound from the forward side of the driver. All other variables being equal, acoustic suspension is generally recognized as superior in fidelity and overall sound quality. Bass-reflex may be a far more efficient means of obtaining deep bass tones, and this dichotomy may represent the current state of the art.

It is commonly understood that a box having equal side lengths may support standing waves at some frequencies but not others, which may cause undesirable fluctuations in the frequency response curve. To reduce standing wave effects, traditional designs depend on some degree of asymmetry and difference of dimension. For example, in a common case of a rectangular box, the length, width and height are usually different values, and sometimes specified in certain ratios to each other. Ported enclosures may permit air to pass back and forth from outside ambient space to inside the box, and in doing so incrementally change the mass of air acting against the back of the piston. These small changes may cause phase delays in the damping response that vary with frequency. There are known methods designed to enhance the performance of the bass-reflex concept, such as those found in *Loudspeaker Design Cookbook* by Vance Dickason. A successful bass-reflex design may depend on the relation of the box resonance $F_3$ to the driver's fundamental resonant frequency $F_s$. These two values may be balanced by tuning the diameter and length of the port tube. A partial fill of fiberglass insulation as a damping material may also be used. The placement of a passive radiator, essentially an unpowered driver, in place of the port, is another technique for minimizing port effects, using the passive radiator's suspension to modulate the exchange with ambient conditions. These methods may reduce the negative effects of exchanging mass with ambient air but may not completely account for the loss of fidelity.

In this context $F_s$, a Thiele/Small parameter, may refer to a property of the driver. It may represent the free-air resonant frequency of the driver piston in Hertz, measured without an enclosure, and may represent the lowest frequency at which a given driver operates at full efficiency. $F_3$ may refer to a common term of art and refer to, e.g., the "minus 3 decibel roll-off" frequency in a completed loudspeaker's SPL performance curve. Because the endpoints of a loudspeaker's performance may not be distinct vertex corners, e.g., at the bass end, after establishing a straight-line average number (e.g. 96 dB), the frequency at which the performance "rolls off" to 3 dB less than the average (in this case 93 dB) may be specified as $F_3$. For the purposes of loudspeaker production $F_3$ may be used as an agreed upon point establishing the lower limit of a given completed unit's capability.

Contemporary loudspeaker engineering may relate box volume to the parameter referred to as $V_{as}$, or compliance equivalent volume. $V_{as}$ indicates the volume of air in a sealed container having the same "springiness" as the driver under test has in free air. Driver manufacturers typically publish specifications listing the "Thiele/Small Parameters" for each driver available for sale to assist loudspeaker design-engineers in selecting units to be used in a given loudspeaker. Box volume $V_b$ determination in acoustic suspension design may start with the Thiele/Small parameter $V_{as}$ and divide it by a factor $\alpha$ obtained from a table calculated to maximize certain characteristics, for example, highest fidelity, maximum bass, maximum damping, or maximum power handling. Values for $\alpha$ may vary from one half to thirty; a common value for acoustic suspension may be three, while for bass-reflex it may be 1.3. The tables were developed by Small and resulted in a quick way for an engineer to obtain a working value for $V_b$ based on compliance ratios, and there are separate tables for sealed and vented loudspeakers. More recently, computer algorithms have been developed for use by designers of loudspeaker systems, into which many Thiele/Small parameters can be fed and which calculate an optimum starting point for $V_b$. While corrections may be made for maximum piston excursion, driver resonance, effective piston diameter, and the Q factors for electrical and mechanical efficiency, the factor that is often given the greatest weight in the calculation is still $V_{as}$, the measure of suspension compliance.

FIG. 1 illustrates a traditional speaker design, in which a driver 100 is placed somewhat off-center within an enclosure 101 to counter the potential effects of the types of standing waves within the enclosure. Any off center mounting will align the piston 102 with a greater mass of air $V_2$ 122 on one side of the excursion axis 103 than the other side $V_1$ 121, and therefore may result in unequal return elasticity from the differing air masses. This can result in incremental differences in the pneumatic pressures across the piston 102, which can cause distortions in the surface resulting in decreased sound quality. In some cases the pneumatic imbalance can cause lateral movement of the electromagnetic coil in the magnet gap resulting in knocking and/or distortion.

Excursion is defined as the extent of linear motion traveled by the piston along the excursion axis 103 of the electromagnetic coil. The rapid back and forth motion on this path is the vibration coupling the electrical signal to the local air masses $V_1$ 121 and $V_2$ 122, and creates the waves which propagate as sound. Maintaining a balance of forces surrounding the excursion axis 103 can have a substantial effect on the ability of the piston 102 surface to create sinusoidal wave patterns. Because of this, much of the engineering effort that goes in to manufacturing high quality drivers concerns balancing the force of the suspension with air gap tolerances in the coil to provide protection against lateral movement while permitting adequate excursion for a given applied force. Asymmetry in the contained air volume can disturb the balance designed into a driver and cause distortions due to the force imbalance.

Traditional design methods seek to balance the performance gain of asymmetry with respect to standing waves against the loss of asymmetry due to pneumatic losses by depending on suspension rigidity within the driver's "spider" to keep the voice coil centered. The improvement in the sound pressure level ("SPL") response curve, however, is countered by increases in distortion, reduction of the dynamic range of the system, and reduced total power handling capability.

SUMMARY

Certain exemplary embodiments of the present disclosure describe a speaker that includes an enclosure that is sealed, thereby containing a volume of gas. The exemplary embodiment may include an audio driver affixed through and substantially in the center of a first side. The exemplary driver may include a piston with a moving mass $M_{ms}$. The exemplary embodiment may enclose a volume of gas has a mass $M_{vb}$ and $M_{vb}$ may be approximately equal to $M_{ms}$. Alternatively, $M_{vb}$ may be substantially equal to 8/7ths of $M_{ms}$. Alternatively, $M_{vb}$ may be between 7/7ths and 9/7ths of $M_{ms}$. Additionally or alternatively, the exemplary speaker may be made up of a plurality of sides, each with an inside face enclosed in the enclosure, and may include at least one inside face that further includes an elastomeric lining.

Certain exemplary embodiments of the present disclosure may include an exemplary speaker that includes an enclosure that is sealed, thereby containing a volume of gas, wherein the enclosure has a first side that includes an audio driver affixed through that first side. The exemplary speaker may include at least one partition wall within the enclosure defining at least two chambers within the enclosure. The exemplary partition wall may include at least one port in the partition wall connecting the at least two chambers. The exemplary speaker may include a main chamber and at least one sub-chamber, wherein the at least one sub-chamber may include a sub-volume of the volume of gas that is approximately equal to a unit fraction of the volume of gas, e.g., one quarter. In certain exemplary embodiments, the audio driver may be within the main chamber. In certain exemplary embodiments, the exemplary at least one partition wall may include at least two ports connecting the at least two chambers. In certain exemplary embodiments, the exemplary at least one partition wall may include exactly four ports connecting the at least two chambers. In certain exemplary embodiments, the exemplary speaker may include at least two partition walls within the enclosure defining at least three chambers within the enclosure. In certain exemplary embodiments, the audio driver may have an effective piston diameter D, and the at least one port may have a diameter that is approximately equal to a unit fraction of D, e.g., one quarter. In certain exemplary embodiments, the at least two chambers may include a main chamber and at least one sub-chamber, and the audio driver that is within the enclosure may be within the main chamber. In certain exemplary embodiments, a sub-chamber may be defined, in part, by a plurality of inside faces, and at least one inside face may include a plurality of recess ports that only extend for a portion of a thickness of enclosure material behind the at least one inside face. In certain exemplary embodiments, at least part of at least one inside face of the enclosure may be coated with an elastomeric lining. In certain exemplary embodiments, the exemplary enclosure may include a second side directly opposite the first side, wherein an inside face of the second side may include a dome protruding into the enclosure, wherein the dome's center point is approximately aligned with a center point of the audio driver.

Certain exemplary embodiments of the present disclosure may include an exemplary speaker that may include an enclosure made up of a plurality of sides, each with an inside face enclosed in the enclosure. At least one part of at least one inside face may include a plurality of recess ports. Each exemplary recess port may include an absence in the enclosure side that does not traverse an entire thickness of the enclosure side. For example, the depth of the absence may be approximately half the thickness of the enclosure side. Additionally or alternatively, the exemplary speaker may also include at least one partition wall within the enclosure defining at least two chambers within the enclosure and at least one port in the partition wall connecting the at least two chambers. In certain exemplary embodiments, each recess port may be substantially similar in shape to the at least one port and may have a diameter that is a unit fraction of a diameter of the at least one port.

DETAILED DESCRIPTION

Exemplary embodiments of the present disclosure may provide dead centering of the driver while suppressing standing waves. The several exemplary features of the enclosure interior have at least two purposes: first, to redistribute the rearward projecting wave energy to every point within the enclosure so as to provide uniformity of force under dynamic conditions, and second to quickly destroy wave energy, e.g. convert such energy to ambient heat. The driver's piston may therefore be supported uniformly under all active conditions by the contained air, and produce audibly clearer tones more efficiently, over a broader spectrum of sound, and at higher power levels, e.g., the full power levels rated by the driver's manufacturer. This may be accomplished through a number of independent or interdependent design features of certain exemplary embodiments of the present disclosure.

Exemplary embodiments of the present disclosure provide a number of inventive features that may isolate and/or neutralize the reaction wave energy propagating from the rear of a loudspeaker driver. As previously discussed, traditional loudspeaker drivers convert an electrical signal to sound by causing a piston to vibrate in air. Sound then emanates from both sides of the driver's piston but while the waves may be equal in force they are opposite in phase. Where these waves meet, they may cancel each other out, and so the maximum audible power obtainable from a loudspeaker may be one-half of the sound energy at the piston. Therefore, some exemplary benefits of isolating and/or neutralizing the sound from the rear side of the driver, may be to prevent the energy from that rearward wave from impinging in any way upon the sound projecting forward by the initial action of the driver.

Figure 1:
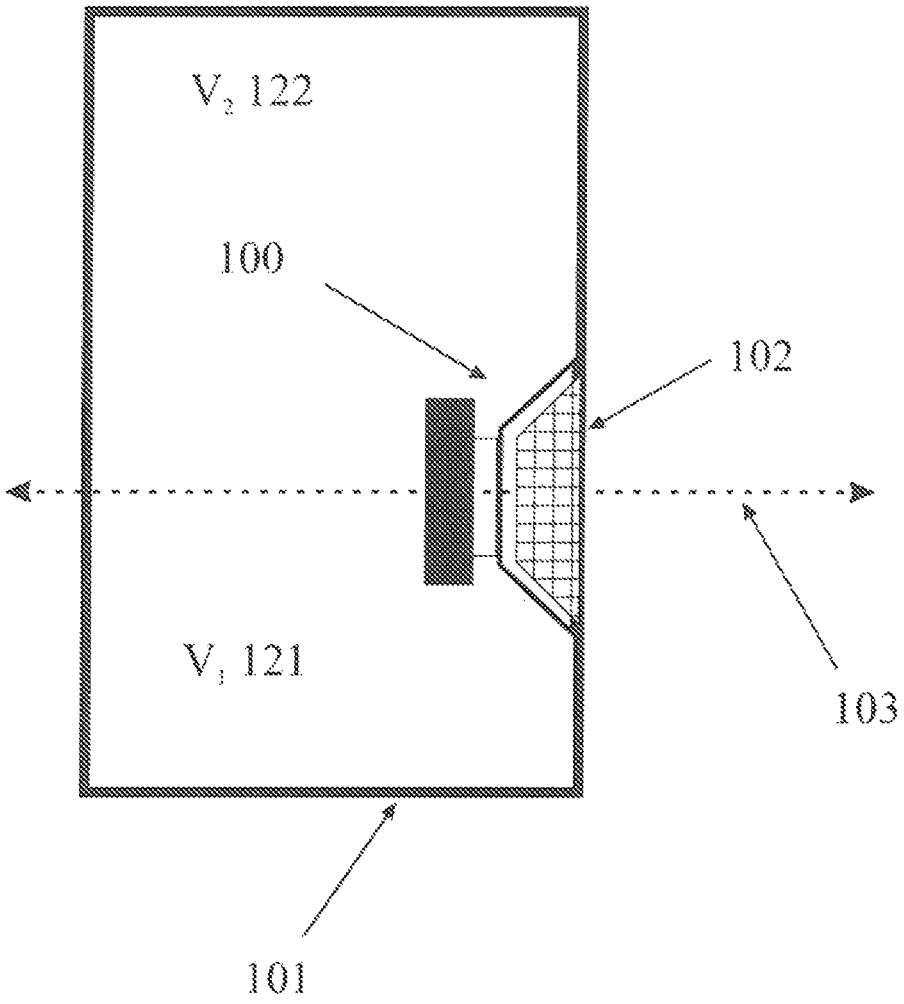
FIG. 1 is a schematic illustration of a prior art speaker design.
Figure 2:
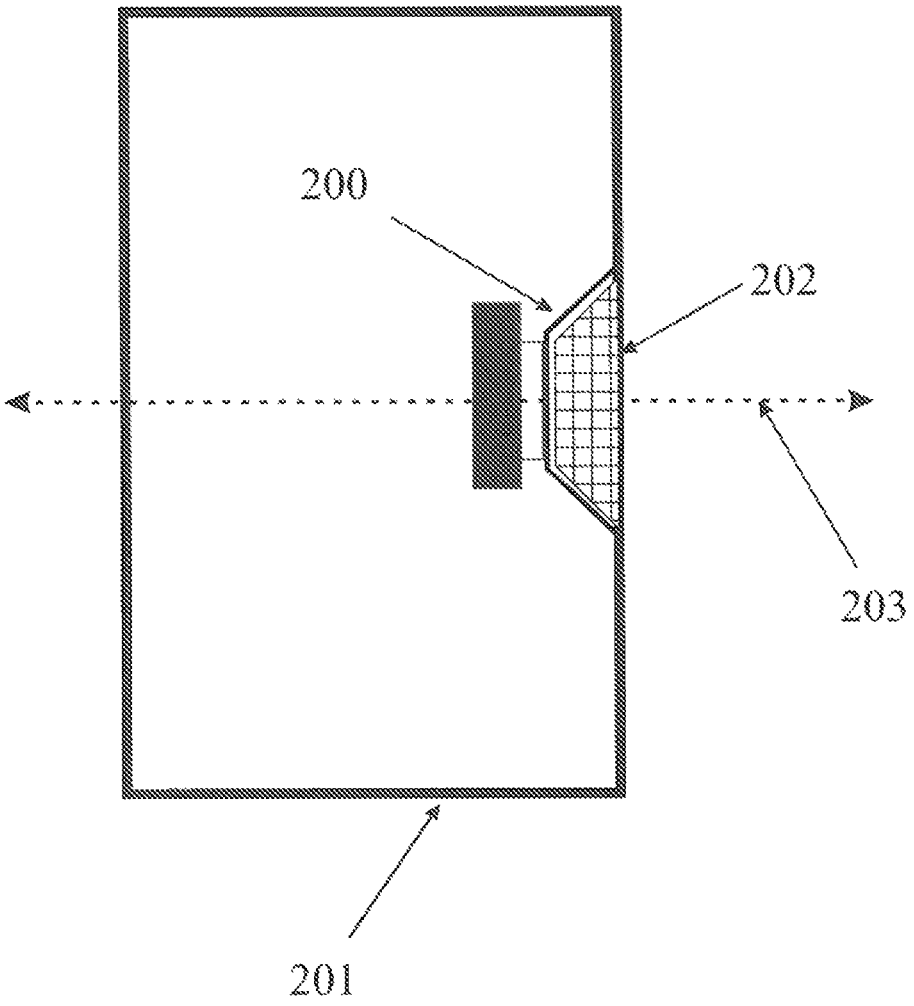
FIG. 2 is a schematic illustration of an exemplary speaker design, according to one exemplary embodiment of the present disclosure.

In one exemplary embodiment, illustrated in FIG. 2, the driver 200 may be mounted on an outside wall of a sealed enclosure 201 that captures a fixed quantity of air. This exemplary embodiment may therefore include symmetry about the excursion axis 203 of the driver 200 and its piston 202, while remaining agnostic as the specific proportions of enclosure 201. Certain exemplary embodiments of the present disclosure may suppress standing waves regardless of the box proportions which may permit greater freedom of box shape design.

Certain exemplary embodiments of the present disclosure may include an air and piston mass balance. Certain exemplary embodiments of the present disclosure include sealed or substantially sealed enclosures designed to hold a particular mass of air. This mass of air may be calculated as a ratio of the moving mass of the driver's piston, commonly referred to as $M_{ms}$. In these exemplary embodiments, matching the moving mass of the driver and enclosed air mass to obtain inertial balance may constitute an exemplary method of establishing a preferred box volume. This balance may set in motion a quantity of air equal to $M_{ms}$ so that regardless of the motion of the piston, the dynamic balance may keep the piston centered on its rest position, e.g. with respect to the forces of air pressure across the piston. With this balance achieved, the driver may be able to produce sound clearly and with full expression throughout its frequency range. The exemplary driver may also be capable of producing higher quality multiple frequency sounds simultaneously.

Exemplary formula F1 illustrates one calculation for identifying an exemplary volume of sealed air enclosure for an exemplary driver. For example, an exemplary driver may have a certain mass $M_{ms}$, described as the mass of the piston and coil, including the acoustic load. The acoustic load may generally refer to the effect the air around the piston has on the moving mass of the whole system. This may essentially be the total mass against which the electromagnetic force does work in free air. $M_{vb}$ may represent an exemplary mass of air to be enclosed in certain exemplary embodiments. In certain exemplary embodiments, $M_{vb}$ may be determined as a function of $M_{ms}$. In one exemplary embodiment, the mass of the enclosed air, $M_{vb}$ may be set to exactly or approximately eight-sevenths of $M_{ms}$. The air within the exemplary enclosures is a complex system, having various attributes and behaviors known in the field of fluid dynamics. When the exemplary piston (e.g., 202) acts on the air within the exemplary enclosure (e.g., 201) not all of the enclosed air reacts with the same magnitude. Because of this, this exemplary embodiment includes a mass of air $M_{vb}$ that is somewhat larger than the piston mass $M_{ms}$ (e.g., about one-seventh larger).

$$M_{vb}=8/7\times M_{ms} \quad \text{F1:}$$

$$V_b=(8/7\times M_{ms})/0.0012041 \text{ g/cc} \quad \text{F2:}$$

Formula F1 includes a specific exemplary mass scalar value for one exemplary embodiment of the present disclosure. Other exemplary embodiments may use different scalar values. Certain exemplary embodiments may actually use a scalar value less than one (e.g., 6/7), making $M_{vb}$ smaller than $M_{ms}$, while other exemplary embodiments may use a scalar value larger than eight-sevenths, e.g., one-and-a-quarter or one-and-a-third, while still other exemplary embodiments may use any particular value between those other exemplary embodiments. Certain preferred embodiments may include a scalar value greater than one, up to, e.g., one-and-a-quarter. In the special case of a subwoofer, where the piston may be very heavy compared to its diameter, and the frequency range may be 20 Hz to 100 Hz only, the scalar may be lower, e.g. 4/7ths, 3/7ths, 5/7ths, ½ or some other fraction in that range.

Once $M_{vb}$ is known (e.g., as a scaled value of $M_{ms}$), the conversion to volume can be made with a few assumptions, e.g., temperature and altitude. Certain exemplary embodiments may select typical values, e.g., one atm ("sea-level") and twenty degrees Celsius ("room-temperature"). With these assumptions there may be approximately 0.0012041 grams of air in a cubic centimeter ("cc") at one atm ("sea-level") and twenty degrees Celsius ("room-temperature"). Applying this mass/volume conversion, e.g., with formula F2, results in an exemplary box volume of 949 cc of enclosed air per gram of moving mass $M_{ms}$ of the driver. It may be noted that humidity can also affect the density of air, but at such a marginal rate that it may be effectively ignored in the exemplary conversions described herein. The exact proportions of the exemplary enclosure may take on any length, width, and height so long as the product of the three values equals or approximates the product of $M_{vb}$ and the mass/volume conversion for air under the assumed or typical conditions.

As was previously mentioned, traditional designs (e.g., acoustic suspension and bass-reflex) calculate their enclosed volumes $V_b$ based on other criteria such as elasticity, while exemplary embodiments of the present disclosure may relate the enclosed air mass to the Thiele/Small parameter $M_{ms}$, defined as the total mass set in motion by the electromagnet, including the acoustic load in free air. To compare, for one 3" diameter driver with $M_{ms}$ of 2.2 grams, an exemplary embodiment of the present disclosure may include a chambered enclosure enclosing around 128 $in^3$ (2100 $cm^3$) of air. That same exemplary 3" diameter driver may list a preferred acoustic suspension $V_b$ as 35 $in^3$ (574 $cm^3$) and a preferred bass-reflex enclosure as 86 $in^3$ (1409 $cm^3$). For another exemplary driver that is 8" in diameter with $M_{ms}$ of 23.9 grams, an exemplary embodiment of the present disclosure may include a chambered enclosure enclosing around 0.8 $ft^3$ (0.023 $m^3$). That same 8" diameter driver may list a preferred acoustic suspension $V_b$ as 0.57 $ft^3$ (0.016 $m^3$) and a preferred bass-reflex size as 1.6 $ft^3$ (0.045 $m^3$).

Figure 3:
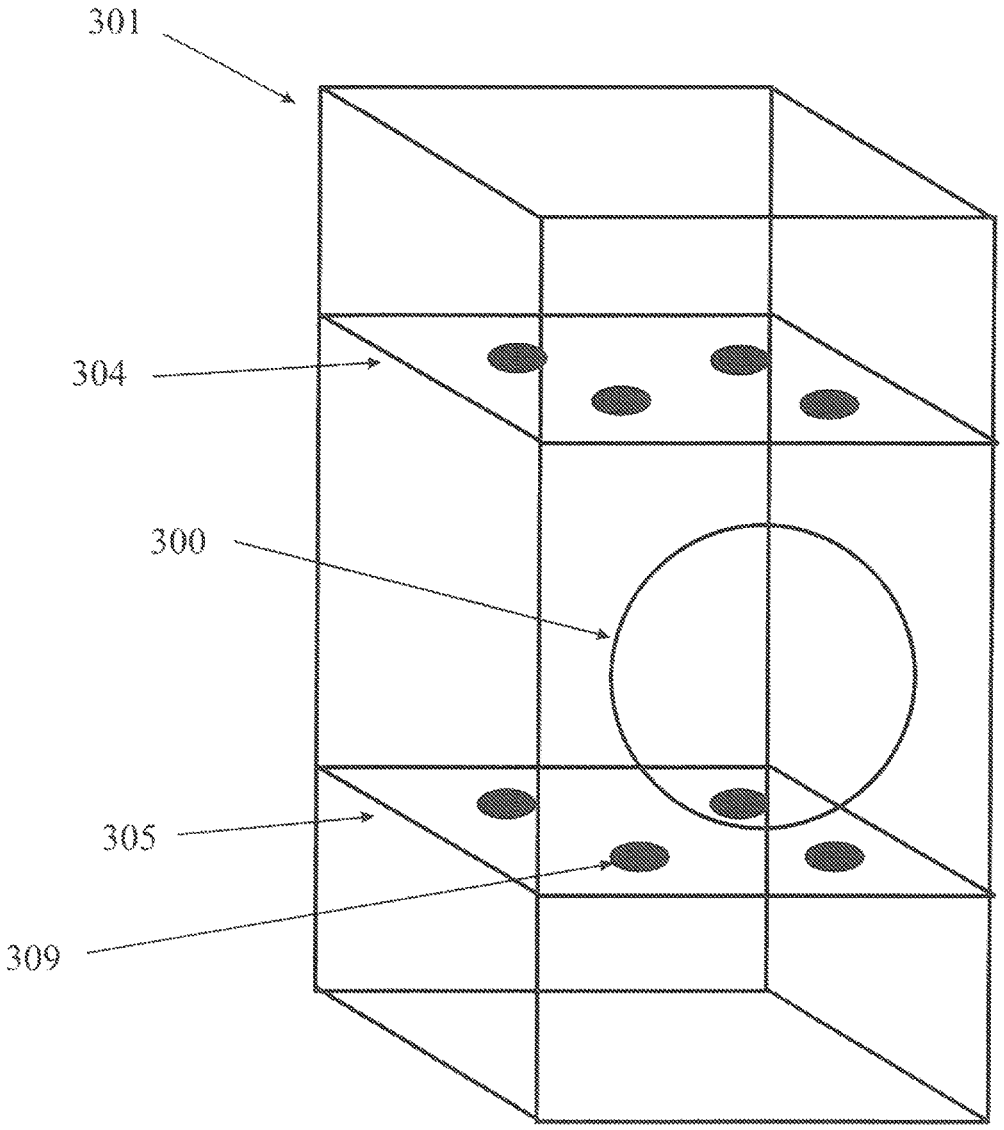
FIG. 3 is a perspective view of an exemplary speaker design, according to one exemplary embodiment of the present disclosure.
Figure 4:
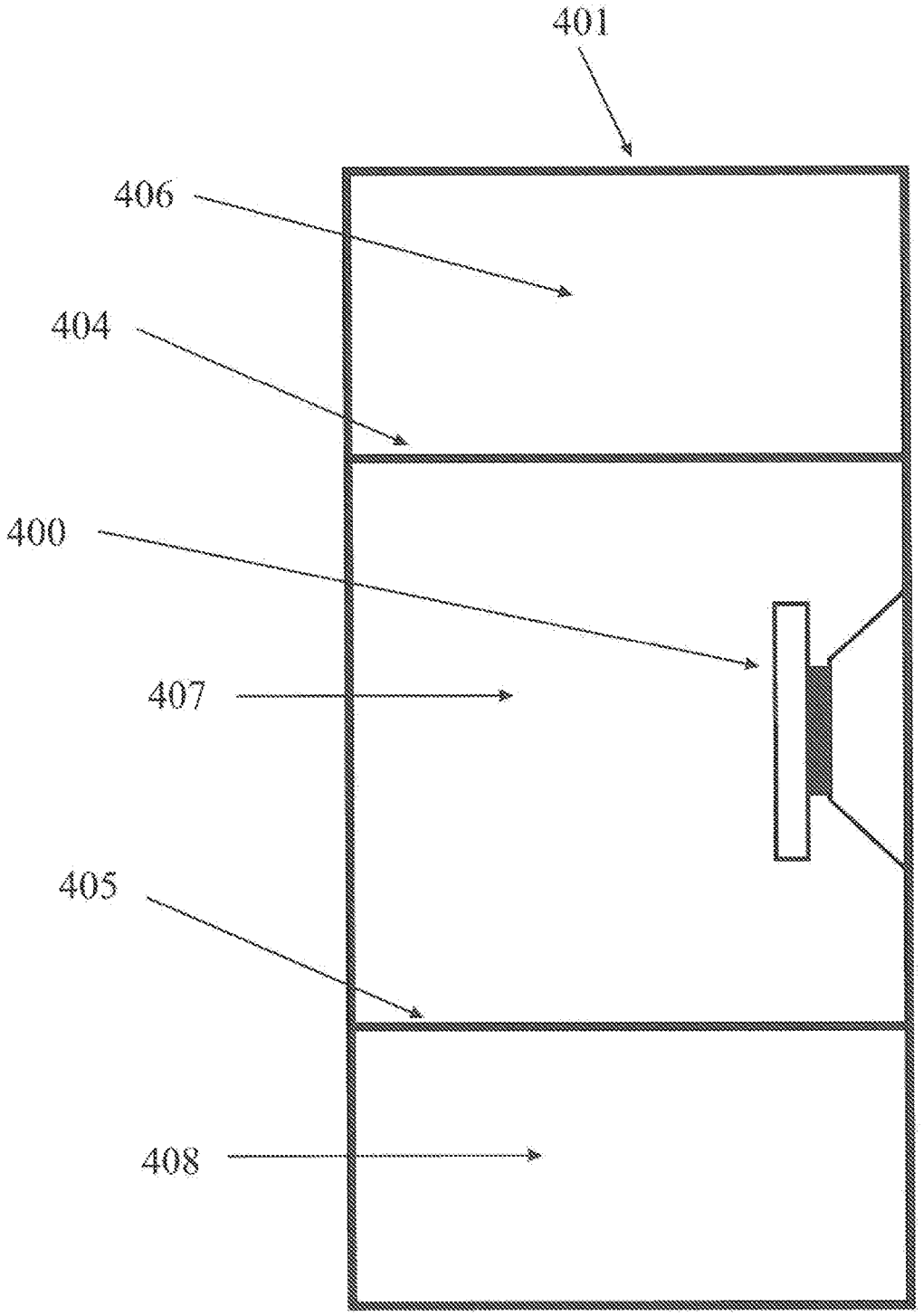
FIG. 4 is a schematic illustration of an exemplary speaker design, according to one exemplary embodiment of the present disclosure.

Certain exemplary embodiments of the present disclosure may include chambers and ports. FIG. 3 illustrates another exemplary embodiment of the present disclosure. FIG. 3 illustrates an enclosure 301 with a driver location 300 in approximately the center of a face of the enclosure 301. While in certain exemplary embodiments the faces of enclosure 301 may be constructed from opaque material, they are illustrated as transparent in FIG. 3 to provide a perspective view into enclosure 301 where two partitions 304 and 305 including ports 309 are illustrated, creating three chambers. For simplicity, FIG. 4 illustrates a two-dimensional view of a similar exemplary embodiment, including a driver 400, enclosure 401, and partition walls 404 and 405. Partition walls 404 and 405 may create three chambers 406, 407, and 408 within exemplary enclosure 401. In the exemplary embodiment depicted in FIG. 4, center chamber 407 includes approximately half the area enclosed by enclosure 401, while side chambers 406 and 408 each include approximately one quarter of the area enclosed by enclosure 401. While FIG. 4 is a two dimensional diagram, it will be understood by a person of ordinary skill in the art that the figure illustrates volumes of an exemplary three dimensional speaker box, according to one or more of the exemplary embodiments described herein. As illustrated, driver 400 may be affixed in approximately the center of a face and thereby in approximately the center of chamber 407.

Figure 5A:
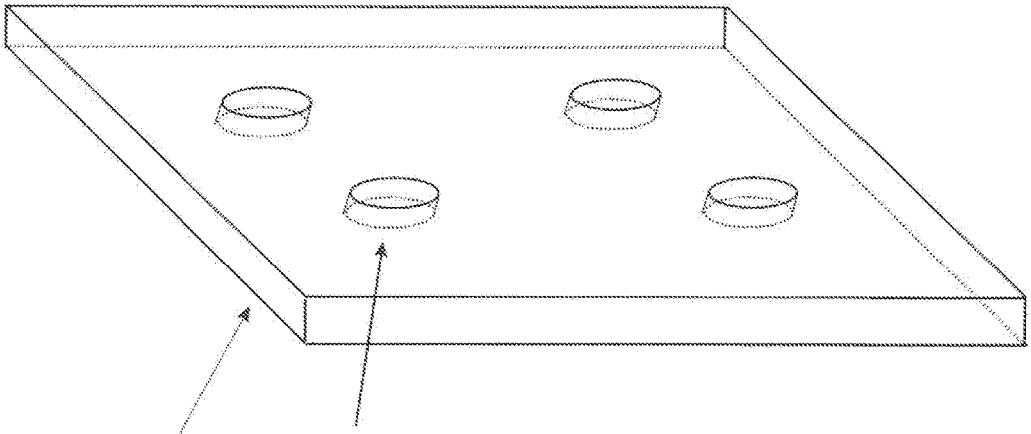
FIG. 5A is an illustration of an exemplary ported partition wall shown in a perspective view, according to one exemplary embodiment of the present disclosure.
Figure 5B:
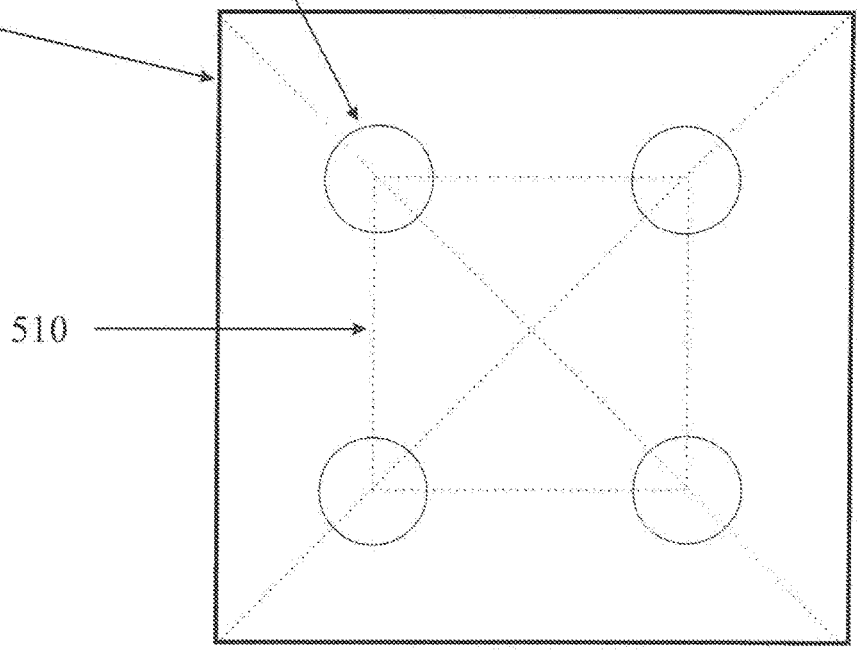
FIG. 5B is an illustration of the exemplary ported partition wall shown in an above view, according to one exemplary embodiment of the present disclosure.

The exemplary partition walls 404 and 405 may include ports, such as exemplary port 309, illustrated in FIG. 3. Exemplary ports are not illustrated in FIG. 4 due to the perspective. FIG. 5B illustrates an exemplary partition wall from a perspective perpendicular to that illustrated in FIG. 4, and FIG. 5A is a perspective view of the same. Exemplary partition wall 505 illustrates four exemplary ports 509. These exemplary ports may comprise holes in partition 505 where air can pass from one chamber to another. Exemplary partition walls 505 may create a seal with exemplary enclosures such that air is substantially isolated between chambers everywhere but the exemplary ports (e.g., 509).

The exemplary enclosure, e.g., 301, may therefore be divided into chambers by ported partition walls whereby a pressure wave originating at the driver piston enters into sub-chambers, e.g., through the exemplary ports so situated as to create substantially equal and separate points of origin for the wave to propagate into the sub-chamber. As waves move into the sub-chamber, creating "port waves," they may cross and interfere with one another, and lose strength. Each pass across the ported partition may weaken the reaction wave further, reducing its ability to bring undesired effects back to the piston. In this way certain exemplary embodiments may fully or partially neutralize reaction energy by employing destructive wave interference, a property of wave mechanics.

In certain exemplary embodiments, at least part of the performance increase may be attributable to the forcing of the air through the ports. Forcing air through the ports is work done and may therefore be a consumer of energy. Displacing a calibrated mass of air across the partition may neutralize the reverse wave energy by consuming its energy in work. In certain exemplary embodiments, e.g., those that base the volume/mass of enclosed air on the moving mass of the piston, at least part of the performance increase may be attributable to this exemplary balanced counterweight movement which may prevent persistent oscillations.

The exemplary ports may be of any size, shape, and/or number. In the exemplary partition 505 of FIG. 5A, the exemplary ports 509 are illustrated as four circular ports concentrically arranged on the partition. That is, four equal diameter ports are arranged with their centers on the corners of an imaginary square 510 concentric to the partition wall, e.g., as illustrated in FIG. 5B. The equality of diameter may provide equality of force among the ports as the wave energy moves through the partition wall, creating four distinct sources of wave energy in the side chamber. While FIG. 5A illustrates 4 exemplary ports, any number of ports are possible in other exemplary embodiments and in certain exemplary embodiments the number of ports may share a relationship with the structure of the partition and/or enclosure. For example, a two dimensional perspective of a certain exemplary enclosure may include a pentagon, and one exemplary partition located therein may include five ports concentrically arranged on that exemplary partition.

Figure 5C:
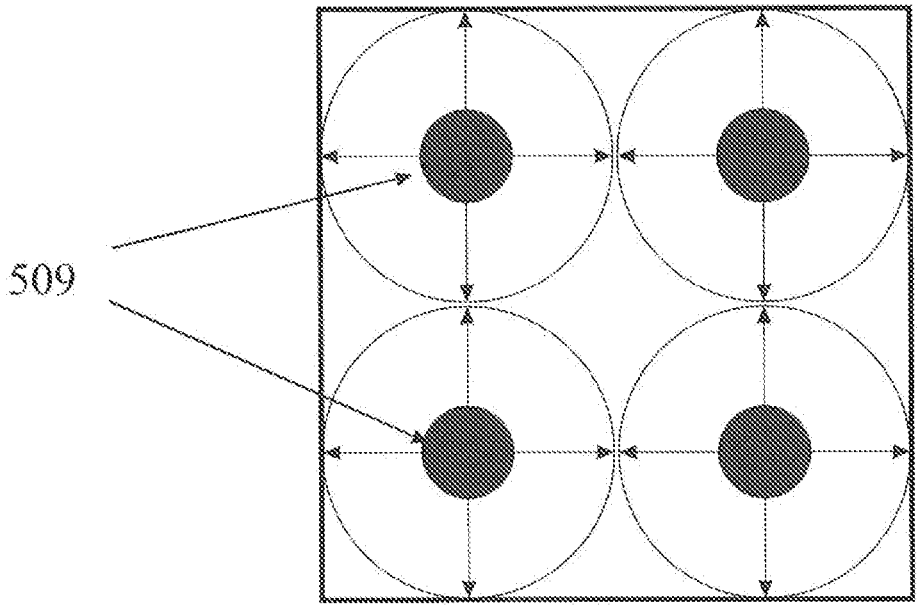
FIG. 5C is an illustration of an exemplary ported partition wall, according to one exemplary embodiment of the present disclosure.
Figure 5D:
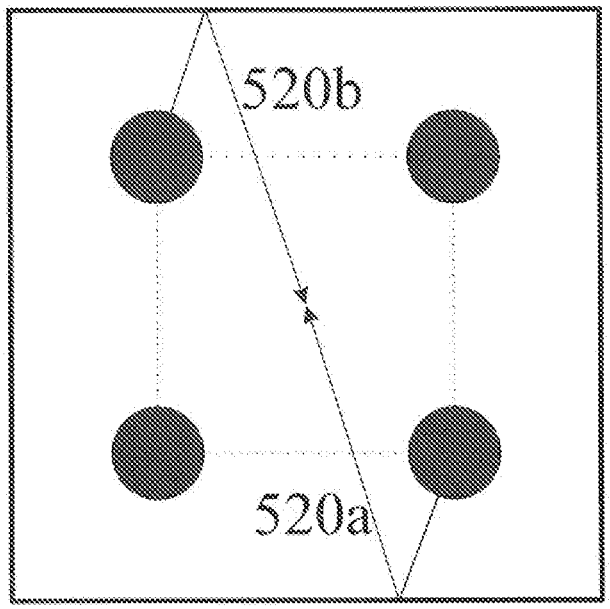
FIG. 5D is an illustration of an exemplary ported partition wall, according to one exemplary embodiment of the present disclosure.

As illustrated in FIG. 5C, the ports 509 may be arranged with centers equidistant from the partition walls and imaginary quadrant dividing lines. In this exemplary arrangement, the symmetry may allow the waves to propagate into the side chamber, each with substantially similar magnitude of force as well as opposition in the various paths of the propagating waves. Containment within the side chamber may provide multiple opportunities for interference due to reflection off of the side walls. FIG. 5D illustrates one exemplary pair of paths 520*a* and 520*b*. For any line radiating at any angle from any port there is the potential for an equal and opposite interfering interaction. Phase angle upon interference is a property of frequency and distance. The geometry illustrated in FIG. 5A-5D provides the opportunity for destructive interference, but may not act upon every frequency identically.

Certain exemplary ports may create a passage in the exemplary partition of any size. In one exemplary embodiment the port size is selected as a unit fraction of the driver's effective piston diameter. An exemplary diameter of port 309 may be selected as a unit fraction, e.g. one-quarter, of the effective piston diameter of exemplary driver 300. The effective piston diameter can be defined as including the full diameter of the moving piston plus one-half of the width of the flexible surround attaching the piston to the fixed frame of the driver. In alternative embodiments, the port may have a diameter of one-half, one-third, one-fifth, etc. The port may even be the same size as the piston diameter or even larger than the piston diameter in certain exemplary embodiments. At a certain point, the port size may become too large or too small to produce a sufficient degree of destructive interference, but a range of possible sizes are at least partially effective and within the scope of alternative exemplary embodiments of the present disclosure. The exemplary embodiment of FIG. 3 however, illustrates eight exemplary ports, each with a diameter one-quarter the effective piston diameter of exemplary driver 300.

Figure 6:
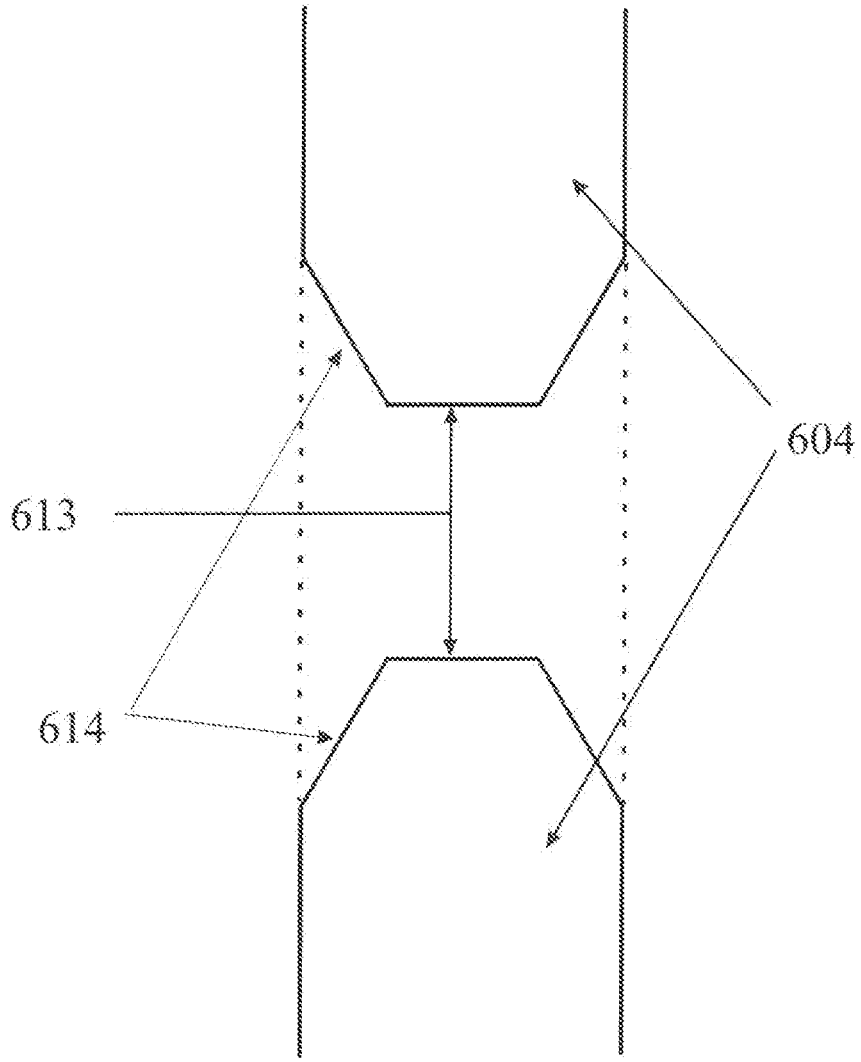
FIG. 6 is a side view of an exemplary port opening, according to one exemplary embodiment of the present disclosure.

The partition wall may be made out of a number of materials and/or at a number of thicknesses. Certain exemplary embodiments may use a partition material substantially similar to the type and/or thickness of the associated exemplary enclosure material. While port throat 613 may define the inner wall-to-wall distance of each port, there may also be a transition area such as port mouth 614. The rim of certain exemplary ports may include a sharp ninety-degree transition from the partition face to the port wall, may include a smoother beveled transition, or may include one or more transitioning faces, such as port mouth 603 illustrated in FIG. 6. The degree of the bevel and/or port mouth(s) of certain exemplary embodiments may be steeper or shallower than the exemplary port mouth 603 illustrated in FIG. 6.

Figure 7:
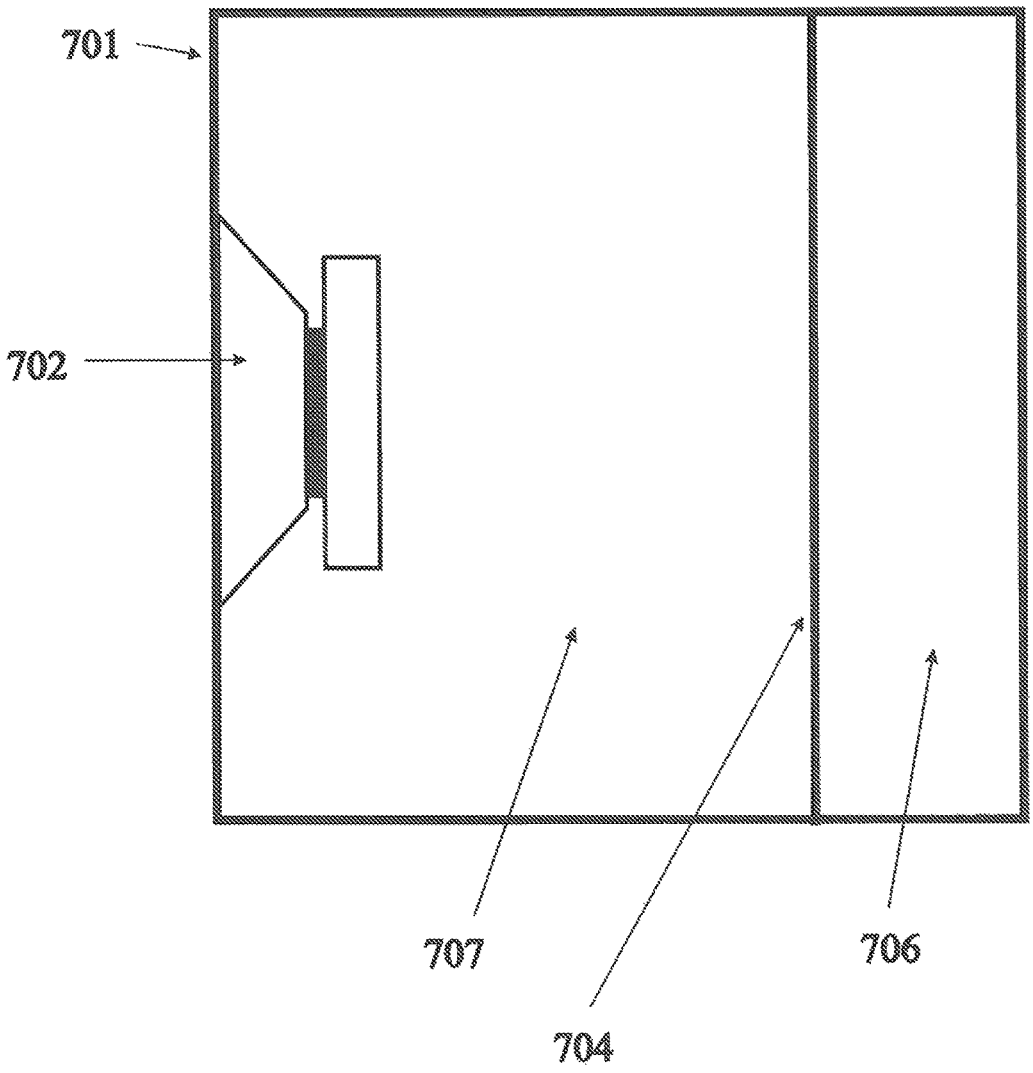
FIG. 7 is a schematic illustration of an exemplary loudspeaker, according to one exemplary embodiment of the present disclosure.

FIGS. 3 and 4 illustrated an enclosure with dual sub-chambers, but other exemplary embodiments are also possible. FIG. 7 illustrates a two dimensional diagram of another exemplary embodiment, having an enclosure 701 with one exemplary partition 704 and one exemplary sub-chamber 706. Sub-chamber 706 may still contain one quarter of the total volume of the enclosure, while main chamber 707 may contain three quarters of the total volume. Alternatively, sub-chamber 706 may contain one third or one half of the total volume or any fraction there between, but may preferably create a sub-chamber with a volume of air approximately equal to a unit fraction of the total enclosed volume of air. Partition wall 704 may be arranged similarly to the exemplary partition wall of FIG. 5.

Within an exemplary partitioned enclosure, e.g., as illustrated in FIG. 3, soundwaves emanating from the rear of driver 300 will travel in multiple directions. Many will pass through the exemplary ports bouncing around within the sub-chamber, losing energy entirely or partially, before randomly exiting the sub-chamber; at which point the reduced energy may have less negative effect on the rear of the piston. One purpose of arranging ports on the exemplary partition wall is to divide the wave energy entering the sub-chamber into equal parts, or port waves, and set these several port waves to act against and upon one another. This opposing action may also occur in the main chamber due to port waves returning from the sub-chambers into the main chamber, e.g., when bulk pressure in the enclosure declines due to piston action. In this way, the exemplary port/chamber arrangement exhibits destructive wave interference, e.g., especially in the bass and midrange frequencies, from the lowest audible frequencies of about 20 Hz to the upper midrange of 5000 Hz, which results in less disturbance on the rear of the driver piston from rearward reflected waves.

Certain exemplary embodiments of the present disclosure may include elastomeric linings. In another exemplary embodiment, all or part of the inside surfaces of an exemplary enclosure include an elastomeric lining. This exemplary construction may absorb sound and, e.g., convert its energy to heat. Certain exemplary embodiments may include methods for constructing such exemplary panels. For example, plywood of an appropriate grade and thickness may be coated with a resilient lining bonded to the interior face. This bonding may take advantage of a phenomena regarding speed of sound differentials in lamina that causes redirection and loss of energy of sound waves. Many types of lamina and materials may be selected for certain exemplary embodiments. Exemplary enclosure materials may include plywood, hardwood, softwood, medium density fiberboard (MDF), particle board, certain plastics, polymers, ceramics, metals, enamels, etc., or any other substantially rigid material. Exemplary elastomeric materials may include latex paint, automobile undercoating, room temperature vulcanization (RTV) rubber, RTV silicone, resilient vinyl flooring sheet, sound muffling sheet, e.g., as typically used under residential flooring, etc., or any other substantially elastomeric material.

Certain exemplary embodiments of the present disclosure may include two materials that have appropriate speed of sound ratings to create an acoustically favorable panel. One exemplary embodiment of a loudspeaker driver, e.g., one that is 10" or smaller in diameter, may include half-inch cabinet grade plywood coated with, e.g., two coats of a latex elastomeric paint with a high solids content. These exemplary panels may enhance containment of the reaction wave and may also contribute to the neutralization of its sound energy.

Certain exemplary embodiments may include an elastomeric coating on every interior surface, including all design features such as partition walls and inverting domes. In the exemplary case of a plywood structure with latex elastomeric paint, it is a further advantage to use the elastomeric lining as the principal assembly glue, as it can be as strong as wood glue but with the additional features of creating resilient rather than rigid bonds between panels, and acting as a gasket to ensure the box is sealed against air exchange. Other exemplary embodiments may only coat certain sections of the enclosure (e.g., the main chamber, one or more sub-chambers, etc.).

Figure 8:
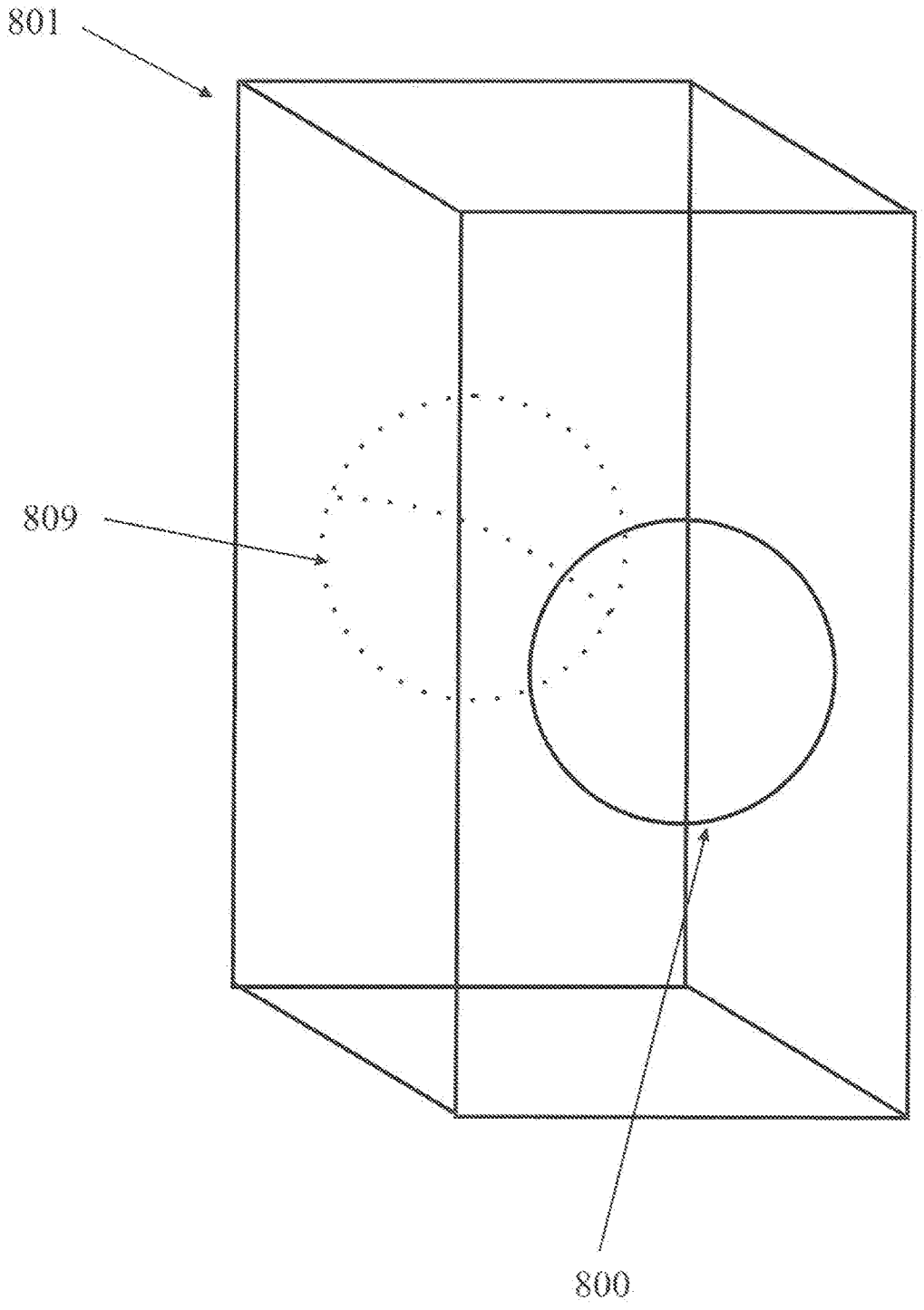
FIG. 8 is a perspective view of an example loudspeaker having an exemplary inverting dome, according to one exemplary embodiment of the present disclosure.

Certain exemplary embodiments of the present disclosure may include inverting domes. FIG. 8 illustrates an exemplary embodiment that includes an enclosure 801 with a driver location 800 and an inverting dome 809, e.g. on the interior wall opposite the driver 800. One exemplary function of inverting domes may be to reverse the direction of, and expand the propagation angle of, any wave impinging against its surface. Both of these functions can promote uniformity of all gaseous conditions within the chamber of placement. An exemplary embodiment may include domes of a diameter equal to the driver's effective piston diameter, and, being a proper section of a sphere, representing a polar cap of approximately 60°. The exemplary dome or domes may be placed in the main chamber in all locations where a wall surface is large enough to accept such, or may be placed in only a subset of wall surfaces (e.g., the wall directly behind the driver). In the main chamber, the dome or domes may support the dynamic action of the piston. FIG. 8 illustrates an exemplary embodiment with a single chamber. However, other exemplary embodiments include an enclosure with ported partitions and sub-chambers (e.g., as illustrated in FIG. 3) along with an exemplary inverting dome (e.g., as illustrated by dome 809 in FIG. 8). Certain exemplary embodiments may include just one dome along the excursion axis, while still other exemplary embodiments may include multiple domes on one or more walls of one or more chambers. One, some, or all of the exemplary domes may have an elastomeric lining the same or similar to other surfaces within exemplary embodiments that include an elastomeric lining, while in other exemplary embodiments the exemplary dome 809 may be of a different material, e.g., without the elastomeric lining.

Figure 9A:
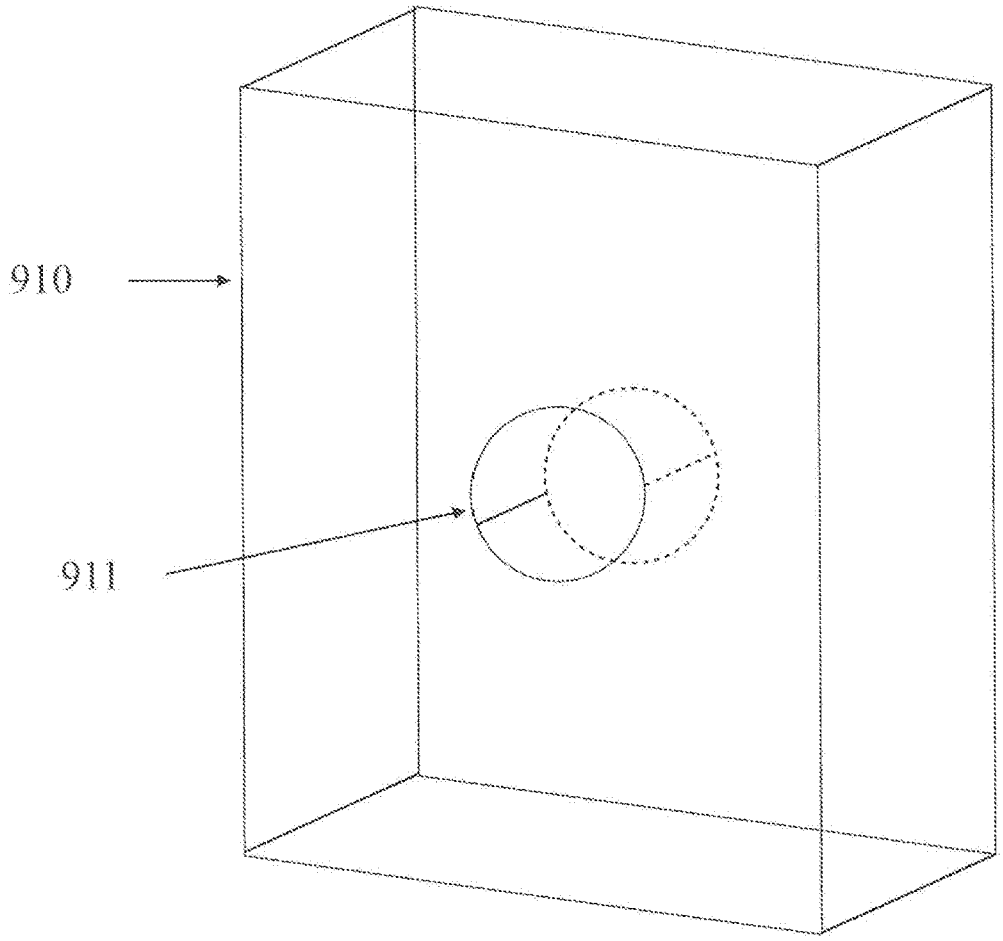
FIG. 9A is an illustration of exemplary recess port in a portion of an exemplary wall, according to one exemplary embodiment of the present disclosure.
Figure 9B:
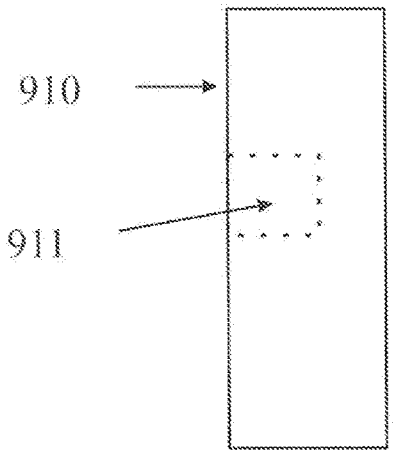
FIG. 9B is an illustration of exemplary recess port in a portion of an exemplary wall viewed from the side, according to one exemplary embodiment of the present disclosure.

Certain exemplary embodiments of the present disclosure may include "Recess Ports." Certain exemplary embodiments include one or more walls with partial ports, herein referred to as "Recess Ports." FIG. 9A illustrates a section of one such wall 910 with exemplary recess ports 911 in a perspective view. The depth of each recess port may be less than the thickness of wall 910, thereby maintaining the seal between the enclosure and outside atmosphere while at the same time providing additional destructive wave interference within the chambers. One example of this is illustrated in FIG. 9B as a side view of the section of wall illustrated in FIG. 9A.

Figure 9C:
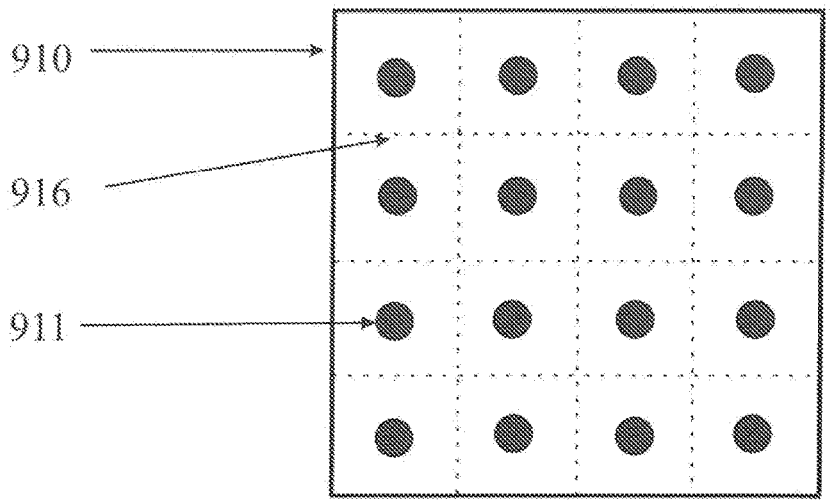
FIG. 9C is an illustration of exemplary recess ports, according to one exemplary embodiment of the present disclosure.
Figure 9D:
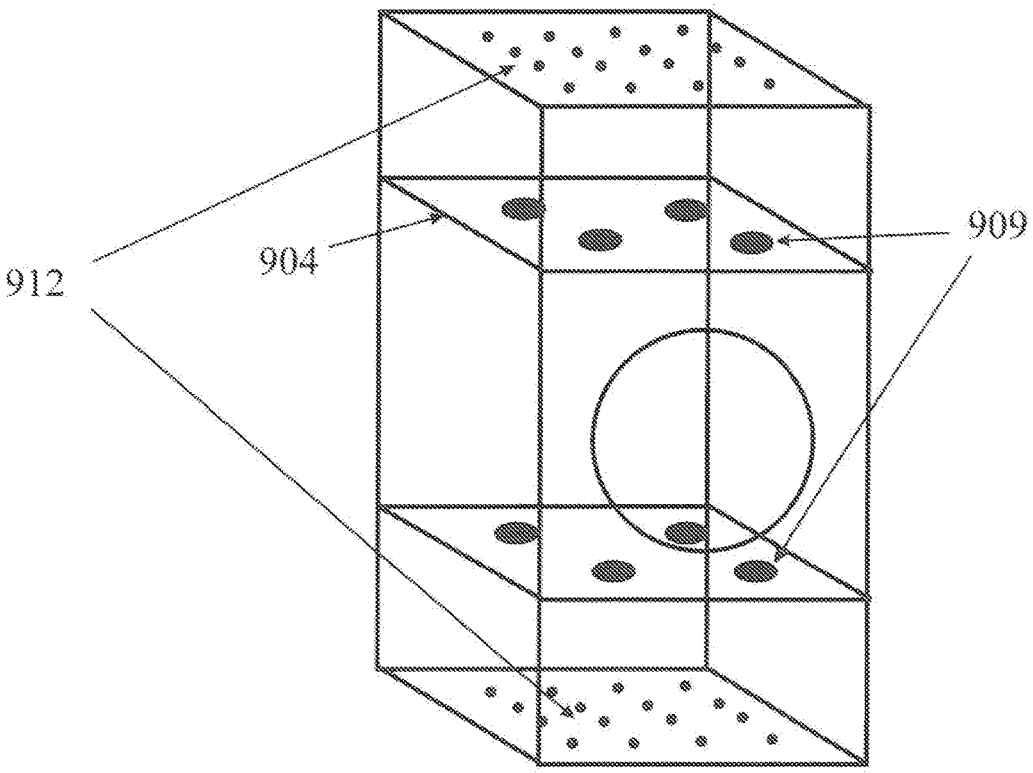
FIG. 9D is an illustration of exemplary recess ports in an exemplary enclosure, according to one exemplary embodiment of the present disclosure.

Exemplary recess ports may be located on the wall 910 of the sub-chamber, e.g., directly opposite the ports passing through the partition wall 904, and in a concentric pattern that replicates the pattern of the exemplary port locations on the partition wall 904. An exemplary pattern, e.g., as illustrated in FIG. 9C, may employ 16 recess ports 911 of diameter one-quarter of the through ports 909. FIG. 9D may illustrate another exemplary embodiment showing a perspective view of an enclosure 900 with recess ports on the inside face of both end walls 912. There may be more or fewer recess ports per wall and/or per unit of area. The recess ports may be located on other walls in addition to or as an alternative to the end walls 912. Recess ports may be located on partition walls, sub-chamber walls, main chamber walls, etc. The number of recess ports may be an integer multiple of the partition ports 909 (e.g., 4 times as many per surface or per surface area). The recess ports may have a diameter that is an integer multiple or unit fraction of the partition port diameter, e.g., one half or one quarter. In certain exemplary embodiments the area of the recess ports may share an integer relationship to the area of the partition ports. For example, four partition ports will have the same area as sixteen recess ports when the diameter of the recess ports is half of the diameter of the partition ports.

Certain exemplary embodiments of the present disclosure may have undergone experimental validation. Speaker tests are often represented by frequency response graph plots, which plot the intensity of output (e.g., in decibels) of a loudspeaker under test over a full spectrum of input frequencies. The magnitude of the input electrical signal is equal at every frequency, so any deviation in the graph from a straight, horizontal line indicates inaccuracy in the loudspeaker. Deviations of less than 1 dB without sharp changes are nearly inaudible. Frequency response graphs 1001, 1002, and 1003 of FIG. 10 were all generated with the same three inch driver, but mounted in three different enclosures. Frequency response graph 1001 is from a chambered enclosures according to one exemplary embodiment of the present disclosure. This reduced to practice exemplary embodiment included the following exemplary features: (1) an enclosed air mass approximately equal to 8/7ths of piston mass $M_{ms}$, (2) an dual partition chamber substantially similar to the exemplary embodiment illustrated in FIG. 3, (3) four partition ports per partition, each with an approximate diameter on quarter the diameter of the driver, (4) recess ports with diameter approximately one eighth the diameter of the driver (on the face opposite the driver and on each end-face opposite the partitions), and (5) two coats of latex elastomeric paint throughout the interior of the chambered enclosure. Frequency response graph 1002 is from a commercial bass-reflex enclosure. Frequency response graph 1003 is from a commercial acoustic suspension enclosure. As mentioned, each enclosure used the same three inch driver.

Figure 10:
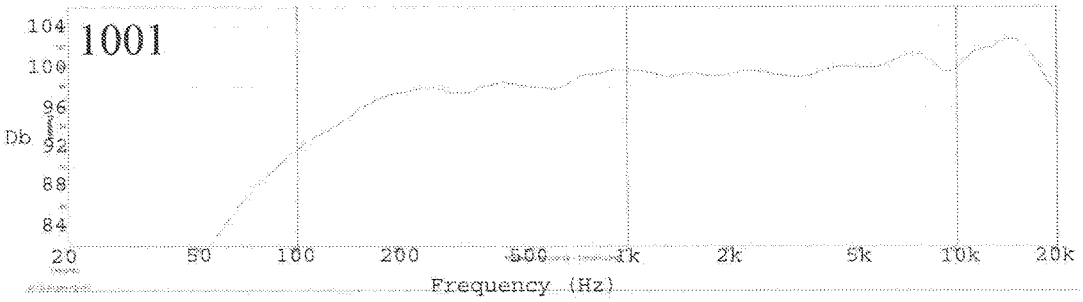
FIG. 10 is an illustration of a frequency response graph-set comparing output of an exemplary embodiment of the present disclosure to commercially available devices.
Figure 10:
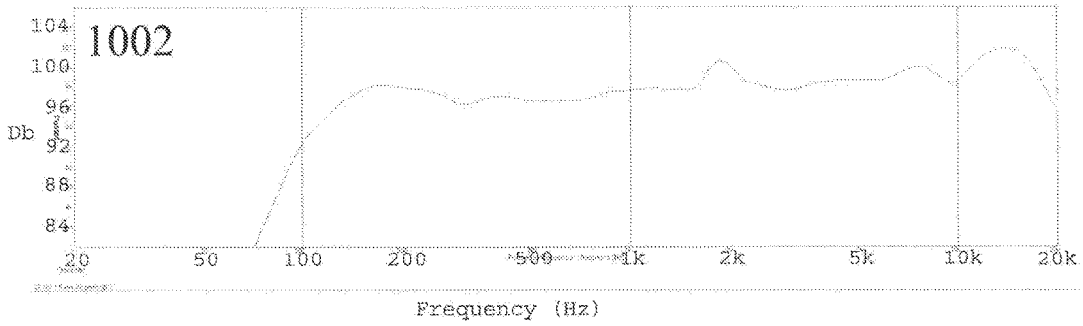
Figure 10:
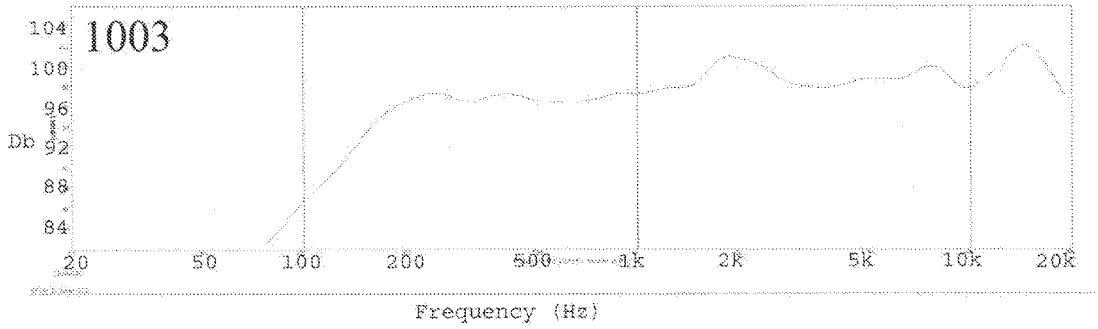

Frequency response graph 1001 of FIG. 10 illustrates the flattest response, deviating +/−1.25 dB between 180 Hz and 6 kHz. It also has approximately no local spikes or humps. Frequency response graph 1002 was generated by the driver in a bass reflex enclosure and clearly shows an audible "boom" in the 160 Hz region as well as an audible spike at 1800 Hz, with deviation of +/−2.5 dB between 150 Hz and 10 K Hz. Frequency response graph 1003 was generated by the driver in an acoustic suspension enclosure and clearly shows a large audible hump centered at 2 K Hz and deviation of +/−2 dB between 220 Hz and 10 K Hz.

Figure 11:
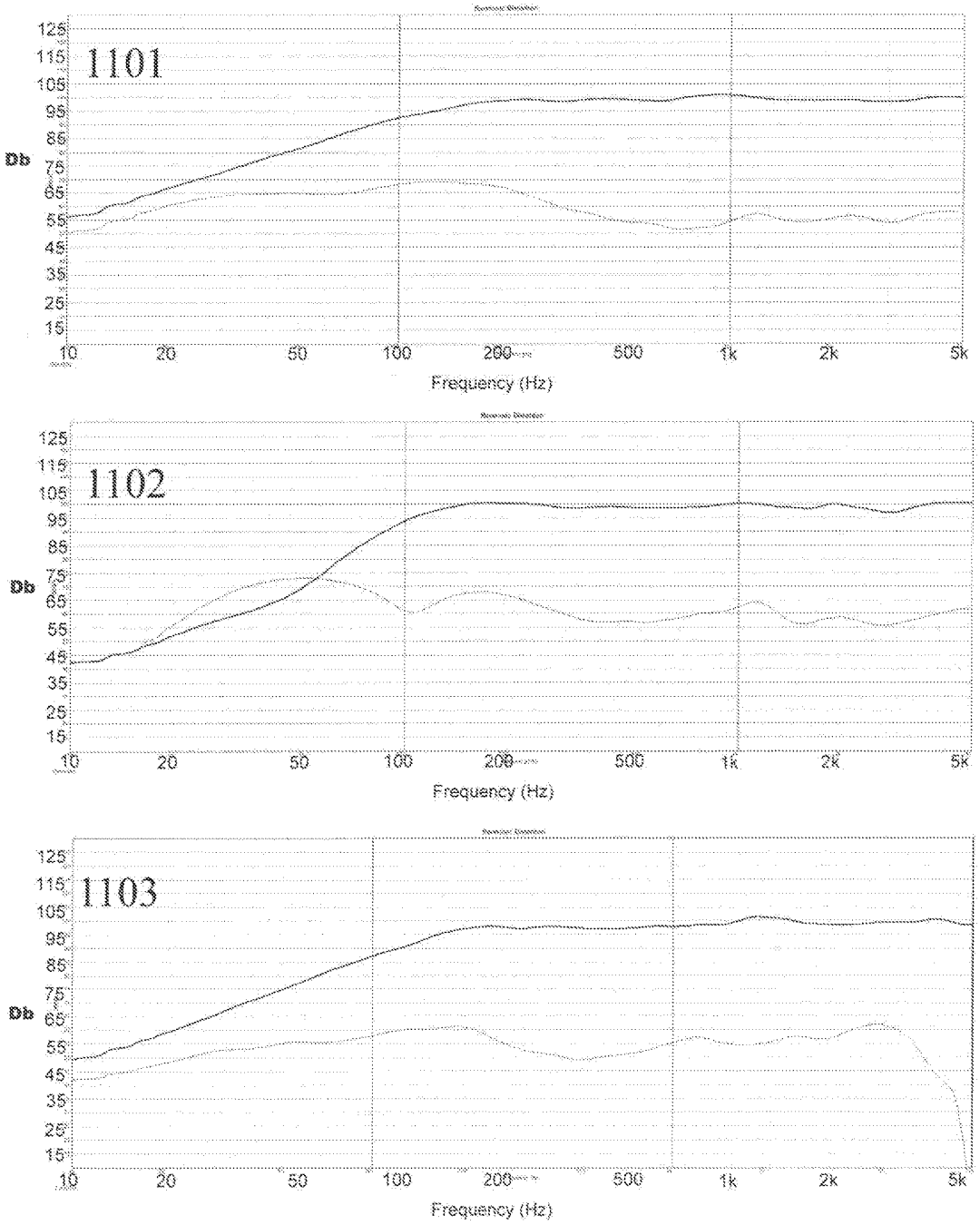
FIG. 11 is an illustration of a distortion graph-set comparing output of an exemplary embodiment of the present disclosure to commercially available devices.

Graph sets 1101, 1102, and 1103 of FIG. 11 illustrate distortion comparisons. In each graph set, the vertical axis shows sound intensity (volume) while the horizontal axis shows frequency. The upper plot represents the intensity of output at the fundamental of each frequency (e.g., the first harmonic). Ideally, this plot should be flat. The lower plot represents the 2nd through 5th harmonics grouped together and referred to as the total harmonic distortion ("THD"). This represents unwanted distortion and ideally should be as small (e.g., low on the vertical axis) as possible. Practically speaking, a THD under 1% of the intensity of the fundamental (e.g., top plot) is considered very good.

FIG. 1101 chambered enclosure and 1103 acoustic suspension follow the same general path, with total harmonic distortion ("THD") increasing from about 2% at 200 Hz to nearly 50% at 20 Hz. In the bass-reflex enclosure graph set, as illustrated in 1102, the speaker produces a maximum of 240% THD at 40 Hz. Distortion greater than the input signal is due to the Helmholtz resonance which in that region overtakes the electrical signal as a force of sound production and actually introduces sounds which were not intended.

Figure 12:
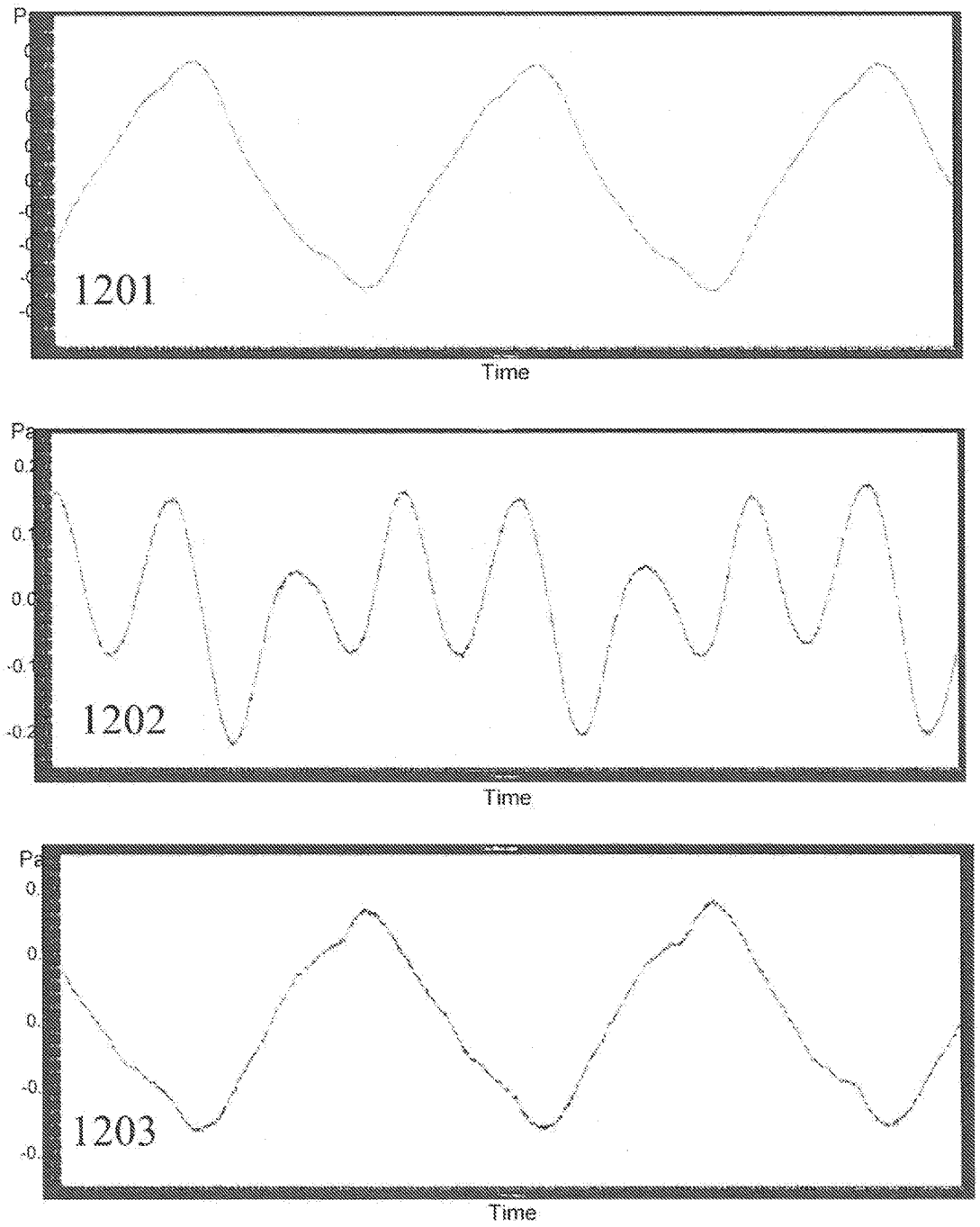
FIG. 12 is an illustration frequency reproduction graph-set comparing output of an exemplary embodiment of the present disclosure to commercially available devices.

Graphs 1201, 1202, and 1203 of FIG. 12 may illustrate output when a constant sinusoidal 50 Hz signal is applied to the chambered enclosure, bass-reflex, and acoustic suspension loudspeakers respectively under test and measured by an oscilloscope. Given the driver used has a free air resonant specification of 100 Hz, perfection of reproduction would not be expected.

Exemplary chambered enclosure graph 1201 and acoustic suspension graph 1203 both deliver a recognizable sinusoidal output of 50 Hz. However, the intensity measured in the chambered enclosure is +/−0.34 Pascals, while the acoustic suspension enclosure delivers +/−0.16 Pascals, or about half of the sound pressure. The sound pressure measures +/−0.2 Pascals in the bass reflex enclosure. The Helmholtz resonance, in combination with the steady electrical input in the 1202 bass reflex enclosure, as seen in output graph 1202, creates an inconsistent output of sound that may be heard as an undulating hum. Graph 1201, representing an output from an exemplary chambered enclosure clearly shows the increase of sound intensity and quality of sound reproduction as compared to either standard enclosure type.

Certain exemplary embodiments of the present disclosure may include other features. Certain exemplary embodiments of the present disclosure may include a filter, e.g., a capacitor filter, of a value that may block frequencies lower than the resonant frequency ($F_s$) of the driver, e.g., as specified by the manufacturer. Applying frequency signals lower than $F_s$ to the driver may cause distortion because the system may not support their conversion to sound. When using a driver to contribute only a specific portion of the sound spectrum in a multiple driver system, it can be advantageous to use a filter of a smaller value to provide a desired lower limit to the frequency produced by the driver in question. In certain exemplary embodiments, the exemplary box size may remain the same, e.g., even if its bass tones are to be blocked. This may be because the box size is keyed to the moving mass of the driver ($M_{ms}$), and the balance of mass established by box size may be independent of the electrical limits in use.

Certain exemplary embodiments may include the addition of a resilient lining bonded to the legs of the speaker driver's basket. The basket may include that portion of the driver which attaches firmly to the enclosure and to which other components of the driver are also attached, e.g., the legs are the portion which reach from the face to the magnet. The spacing of the legs may define windows through which the rear face of the piston acts upon the air volume in the enclosure. For example, a resilient lining bonded to the legs of the speaker driver's basket may be used in cases where the exemplary driver has a stamped steel frame and a significant amount of surface area of steel facing the back side of the piston or any other such similar driver configuration. In this exemplary embodiment the exemplary resilient lining bonded to the legs of the speaker driver's basket may reduce high frequency resonances that may form from a quick return to the piston surface, causing distortion and tinniness. Any exemplary resilient layers bonded to the steel surfaces facing the piston may reduce the impact of resonance in the basket. For smaller drivers, e.g., four inches or less in diameter, the exemplary elastomeric paint used in making certain exemplary wall panels may be effective. For embodiments with larger speakers, it may be advantageous to use a rubber mold putty or similar such material to build a layer of rubber bonded to the basket. The exemplary rubber layer may have any thickness, such as being an eighth of an inch thick.

Although features and elements are described above in particular combinations, one of ordinary skill in the art will appreciate that each feature or element can be used alone or in any combination with the other features and elements. Certain exemplary embodiments discuss a volume being "sealed." While certain exemplary embodiments can include enclosures that are "totally sealed," e.g., "hermetically sealed," other exemplary embodiments use the term "sealed" to refer to being "practically sealed." That is, gases (e.g., air) within an exemplary enclosure may remain constant over shorter timeframes (e.g., the changes in pressure caused by the movement of the diver piston), while nonetheless being able to equalize to the outside pressure over longer periods of time (e.g., being moved from a sea-level location to a higher altitude location).

While the invention has been described in connection with specific examples and various embodiments, it should be readily understood by those skilled in the art that many modifications and adaptations of the invention described herein are possible without departure from the spirit and scope of the invention as claimed hereinafter. Thus, it is to be clearly understood that this application is made only by way of example and not as a limitation on the scope of the invention claimed below. The description is intended to cover any variations, uses or adaptation of the invention following, in general, the principles of the invention, and including such departures from the present disclosure as come within the known and customary practice within the art to which this description pertains.

The invention claimed is:

1. A speaker, comprising:

an enclosure that is sealed, thereby containing a volume of gas, wherein the enclosure has a first side;

an audio driver affixed through the first side;

at least one partition wall within the enclosure defining at least two chambers within the enclosure;

at least two ports in the partition wall connecting the at least two chambers.

2. The speaker recited in claim 1, wherein the at least two chambers include a main chamber and at least one sub-chamber, wherein the at least one sub-chamber includes a sub-volume of the volume of gas that is approximately equal to a unit fraction of the volume of gas.

3. The speaker recited in claim 2, wherein the unit fraction is one-quarter.

4. The speaker recited in claim 2, wherein any portion of the audio driver that is within the enclosure is within the main chamber.

5. The speaker recited in claim 1, wherein the at least one partition wall includes exactly four ports connecting the at least two chambers.

6. The speaker recited in claim 1, further comprising:

at least two partition walls within the enclosure defining at least three chambers within the enclosure.

7. The speaker recited in claim 1, wherein the audio driver has an effective piston diameter D, and the at least two ports each have a diameter that is approximately equal to a unit fraction of D.

8. The speaker recited in claim 7, wherein the unit fraction is one-quarter.

9. The speaker recited in claim 1, wherein the at least two chambers include a main chamber and at least one sub-chamber, wherein any portion of the audio driver that is within the enclosure is within the main chamber, wherein the sub-chamber is defined, in part, by a plurality of inside faces, and wherein at least one inside face includes a plurality of recess ports that only extend for a portion of a thickness of enclosure material behind the at least one inside face.

10. The speaker recited in claim 1, wherein at least part of at least one inside face of the enclosure is coated with an elastomeric lining.

11. The speaker recited in claim 1, wherein the enclosure includes a second side directly opposite the first side, wherein an inside face of the second side includes a dome protruding into the enclosure, wherein the dome's center point is approximately aligned with a center point of the audio driver.

12. A speaker, comprising:

an enclosure that is sealed, thereby containing a volume of gas, wherein the enclosure has a first side;

at least one partition wall within the enclosure defining at least two chambers within the enclosure;

at least one port in the partition wall connecting the at least two chambers;

an audio driver affixed through and substantially in the center of the first side, wherein the driver includes a piston with a moving mass $M_{ms}$; and wherein the volume of gas has a mass $M_{vb}$ and wherein $M_{vb}$ is approximately equal to $M_{ms}$.

13. The speaker recited in claim 12, wherein $M_{vb}$ is substantially equal to 8/7ths of $M_{ms}$.

14. The speaker recited in claim 12, wherein $M_{vb}$ is between 7/7ths and 9/7ths of $M_{ms}$.

15. The speaker of claim 12, where the enclosure is made up of a plurality of sides, each with an inside face enclosed in the enclosure, wherein at least one inside face further comprises an elastomeric lining.

16. A speaker, comprising:

an enclosure made up of a plurality of sides, each with an inside face enclosed in the enclosure, wherein at least one part of at least one inside face includes a plurality recess ports, each recess port comprising an absence in the enclosure side that does not traverse an entire thickness of the enclosure side;

at least one partition wall within the enclosure defining at least two chambers within the enclosure; and at least one partition port in the partition wall connecting the at least two chambers.

17. The speaker of claim 16, wherein a depth of the absence is approximately half the thickness of the enclosure side.

18. The speaker of claim 16, wherein each recess port is substantially similar in shape to the at least one partition port and has a diameter that is a unit fraction of a diameter of the at least one partition port.

* * * * *